US008611797B2

(12) United States Patent
Maeda et al.

(10) Patent No.: US 8,611,797 B2
(45) Date of Patent: Dec. 17, 2013

(54) DEVELOPING DEVICE AND IMAGE FORMING APPARATUS INCLUDING PASSING DEVELOPER AMOUNT CHANGING MECHANISM

(75) Inventors: Osamu Maeda, Sanda (JP); Shunichi Takaya, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 261 days.

(21) Appl. No.: 13/070,224

(22) Filed: Mar. 23, 2011

(65) Prior Publication Data

US 2011/0236074 A1 Sep. 29, 2011

(30) Foreign Application Priority Data

Mar. 24, 2010 (JP) ..... 2010-068229

(51) Int. Cl.
*G03G 15/08* (2006.01)

(52) U.S. Cl.
USPC ..... 399/254

(58) Field of Classification Search
USPC ..... 399/254
See application file for complete search history.

(56) References Cited

U.S. PATENT DOCUMENTS

| | | | | |
|---|---|---|---|---|
| 8,401,431 | B2 * | 3/2013 | Ikeda | 399/253 |
| 2004/0131390 | A1 | 7/2004 | Kita | |
| 2007/0077098 | A1 | 4/2007 | Katsuyama et al. | |

FOREIGN PATENT DOCUMENTS

| | | |
|---|---|---|
| CN | 1523456 | 8/2004 |
| JP | 2001-265098 | 9/2001 |
| JP | 2002-287496 | 10/2002 |
| JP | 2005-221852 | 8/2005 |
| JP | 2009-48139 | 3/2009 |
| JP | 2009-300584 | 12/2009 |

OTHER PUBLICATIONS

Translation of JP2002-287496A to Tanaka; Oct. 3, 2002.*
Computer translation of JP2009-300584A to Kanazaki, Dec. 2009.*
First Office Action dated Nov. 5, 2012, directed to Chinese Application No. 201110146318.7; 18 pages.
Notification of Reasons for Refusal mailed Feb. 7, 2012, directed to Japanese Application No. 2010-068229; 7 pages.

* cited by examiner

*Primary Examiner* — Quana M Grainger
(74) *Attorney, Agent, or Firm* — Morrison & Foerster LLP

(57) ABSTRACT

A developing device that circulates developer in a circulation passage having first and second conveyance passages, so that the developer is supplied to a developing roller along the first or second conveyance passages, comprising: a first conveyance member in the first conveyance passage driven to rotate to convey the developer in a first conveyance direction; a communicating passage through which the developer flows from the first to second conveyance passages; a second conveyance member in the second conveyance passage driven to rotate to convey the developer in a second conveyance direction; a discharge passage extending from an end portion of the first conveyance passage located downstream in the first conveyance direction; and a passing developer amount changing mechanism configured to change an amount of developer passing through the communicating passage, according to a pressure applied to the developer at a junction between the first conveyance passage and the discharge passage.

19 Claims, 9 Drawing Sheets

DEVELOPING DEVICE AND IMAGE FORMING APPARATUS INCLUDING PASSING DEVELOPER AMOUNT CHANGING MECHANISM

This application is based on application No. 2010-068229 filed in Japan, the content of which is hereby incorporated by reference.

BACKGROUND OF THE INVENTION (1) Field of the Invention

The present invention relates to a developing device and an image forming apparatus including the developing device. In particular, the present invention relates to technology to keep the amount of developer stable in a developing chamber in a trickle-type developing device using two-component developer.

(2) Description of Related Art

As a developing device included in an electrophotographic image forming apparatus, a developing device employing a two-component development method is in widespread use. The two-component development-type developing device uses developer including toner and carrier.

As such a developing device is used for a long period of time, the more amount of dust adheres to surfaces of the carrier. This gradually reduces an ability of the carrier to charge toner (the carrier with low charging ability is referred to as spent carrier), and leads to a problem like a fog, toner dispersion, and so on.

In order to solve the above-mentioned problem, a so-called trickle-type developing device has been proposed. The trickle-type developing device discharges developer including the spent carrier little by little while supplying fresh developer little by little, and thus curbs the increase in the amount of the spent carrier.

With this structure, by utilizing an increase in the volume of developer due to addition of fresh developer, excessive developer including the spent carrier are discharged little by little and replaced by developer including fresh carrier. Therefore, the problem like a fog and toner dispersion becomes less likely to be caused.

A basic subject on the trickle-type developing device is keeping the amount of developer, more specifically the amount of carrier, stable in the developing device.

Discharging an amount of developer exceeding the amount necessary to replace carrier with low charging ability is inefficient because maintenance costs increase unnecessarily. Moreover, excessive discharge of developer is nothing but a temporary reduction in the amount (volume) of developer in a developing device, and leads to a shortage of developer. Therefore, a sufficient amount of developer is not supplied to a developing roller, resulting in negative effects like uneven development.

In order to keep the amount of developer in a trickle-type developing device stable, various efforts have been made.

As one of the efforts, the following structure has been proposed. An opening for discharging developer is provided at a portion of the developing chamber, in particular at a portion higher than an assumed surface level of developer, so that an excessive amount of developer caused by supplying fresh developer is overflowed and discharged from the opening.

However, it is commonplace for an electrophotographic image forming apparatus to change a speed in the whole process (system speed) depending on a sheet type, an image quality mode, and so on. Therefore, a speed of conveying developer in a developing device also changes depending on a selected mode. Due to a change in a circulation speed of developer, a partial change in pressure and volume of developer is caused. With the above-mentioned structure, discharging of developer is controlled only by the volume of developer, and therefore directly affected by pressure fluctuations caused by a change in a driving speed. Therefore, it is difficult to keep the amount of developer stable.

Considering the structure of a developing unit, the discharge opening for overflowing developer is commonly provided at an end portion located downstream in a developer conveyance direction (hereinafter, referred simply to as "downstream") of a conveyance passage in which a developer conveyance screw is housed. With this structure, developer is more likely to be discharged in high-speed driving, because a pressure applied to developer increases at the discharge opening. On the other hand, developer is less likely to be discharged in low-speed driving, because the pressure applied to developer decreases at the discharge opening.

This causes a large difference in a stable amount of developer in a developing chamber between high-speed driving and low-speed driving. In particular, a developing chamber has a shortage of developer while the device is driven at a high speed, or when the device is driven at a low speed after being driven at a high speed. This increases the risk of uneven development caused due to short supply of developer.

In order to solve the above-mentioned problem in a developing device utilizing an overflow of developer from a discharge opening provided at a high portion of the developing chamber, a developing device that utilizes not only a change in the volume of developer but also pressure balance in conveying developer is proposed.

Such a pressure balanced developing device controls the amount of developer to be discharged not by providing a discharge opening at a high portion of the developing chamber, but by providing a conveyance member, in front of a discharge opening, that is capable of conveying developer in a direction opposite to the developer conveyance direction. A pressure is applied by the conveyance member in the direction opposite to the developer conveyance direction. The amount of developer to be discharged is controlled by utilizing balance between a pressure applied in the developer conveyance direction and the pressure applied in the opposite direction.

Specifically, the following structure is commonly used. At a downstream end of a normal conveyance screw that does not face a developing roller (hereinafter, ends of a screw not facing a developing roller are also referred to as "hidden portions of a screw"), another screw helically winding in a reverse direction is formed. In addition, a discharge opening is provided further downstream in a conveyance passage than the reverse screw. The discharge opening is provided at a position lower than a normal surface level of developer, and therefore does not have an ability to control the amount of developer to be discharged. Developer that overcomes a pressure applied by the reverse screw in the direction opposite to the developer conveyance direction is conveyed and discharged from the discharge opening.

An advantage of the structure is that the amount of discharge developer is controlled by utilizing not only a change in the volume of developer but also pressure balance in conveying developer. In particular, when the developing device is driven at a high speed or also is driven at a low speed, the pressure applied in the normal developer conveyance direction and the pressure applied in the opposite direction change simultaneously. As a result, the amount of discharged developer is kept relatively constant by the pressure balance therebetween.

However, the above-mentioned pressure balanced developing device does not completely eliminate a difference in the amount of developer in a developing chamber between high-speed driving and low-speed driving.

The reason is as follows. In high speed driving, a conveyance force acting in a forward direction that is applied by the normal conveyance screw is increased, and also a conveyance force acting in a reverse direction that is applied by the reverse screw is increased. However, the conveyance force in the forward direction is normally set to be greater than the conveyance force in the reverse direction. Therefore, the conveyance force in the forward direction increases more greatly than the conveyance force in the reverse direction, and thus a difference therebetween becomes greater. As a result, developer to which a high pressure is applied overcomes the reverse screw, and is discharged unnecessarily. A larger amount of developer can be discharged in high speed driving than that in low speed driving.

In particular, in order to respond to a recent demand for miniaturization of an image forming apparatus, the developing device itself needs to be made small in size, and thus a developing chamber in a developing device needs to be made small in capacity. Accordingly, even a small change in the amount of discharged developer significantly affects a surface level of developer in a conveyance passage facing a developing roller. When the surface level of developer is lowered due to temporary discharge of an excessive amount of developer, a sufficient amount of developer cannot be supplied to the developing roller, resulting in occurrence of uneven development.

SUMMARY OF THE INVENTION

The present invention has been achieved in view of the above problem, and aims to keep the amount of developer relatively constant in a trickle-type developing device to prevent the occurrence of uneven development by controlling the amount of developer to be discharged.

In order to achieve the above aim, one aspect of the present invention is a developing device that circulates developer including carrier and toner in a circulation passage having first and second conveyance passages by conveying the developer in a first conveyance direction in the first conveyance passage and conveying the developer in a second conveyance direction in the second conveyance passage, so that the developer is supplied to a developing roller provided along one of the first and second conveyance passages, the developing device comprising: a first conveyance member provided in the first conveyance passage and driven to rotate to convey the developer in the first conveyance direction; a communicating passage through which the developer flows from the first conveyance passage to the second conveyance passage; a second conveyance member provided in the second conveyance passage and driven to rotate to convey the developer that has flowed through the communicating passage in the second conveyance direction; a discharge passage extending from an end portion of the first conveyance passage located downstream in the first conveyance direction; and a passing developer amount changing mechanism configured to change an amount of developer per unit time passing through the communicating passage, according to a pressure applied to the developer at a junction between the first conveyance passage and the discharge passage.

Also, in order to achieve the above aim, another aspect of the present invention is an image forming apparatus including the developing device.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings.

DESCRIPTION OF PREFERRED EMBODIMENTS

The following describes a developing device, and an electrophotographic image forming apparatus including the developing device in an embodiment of the present invention. A monochrome printer (hereinafter, referred simply to as a "printer") is taken as an example.

(1) Overall Structure of Printer

Figure 1:
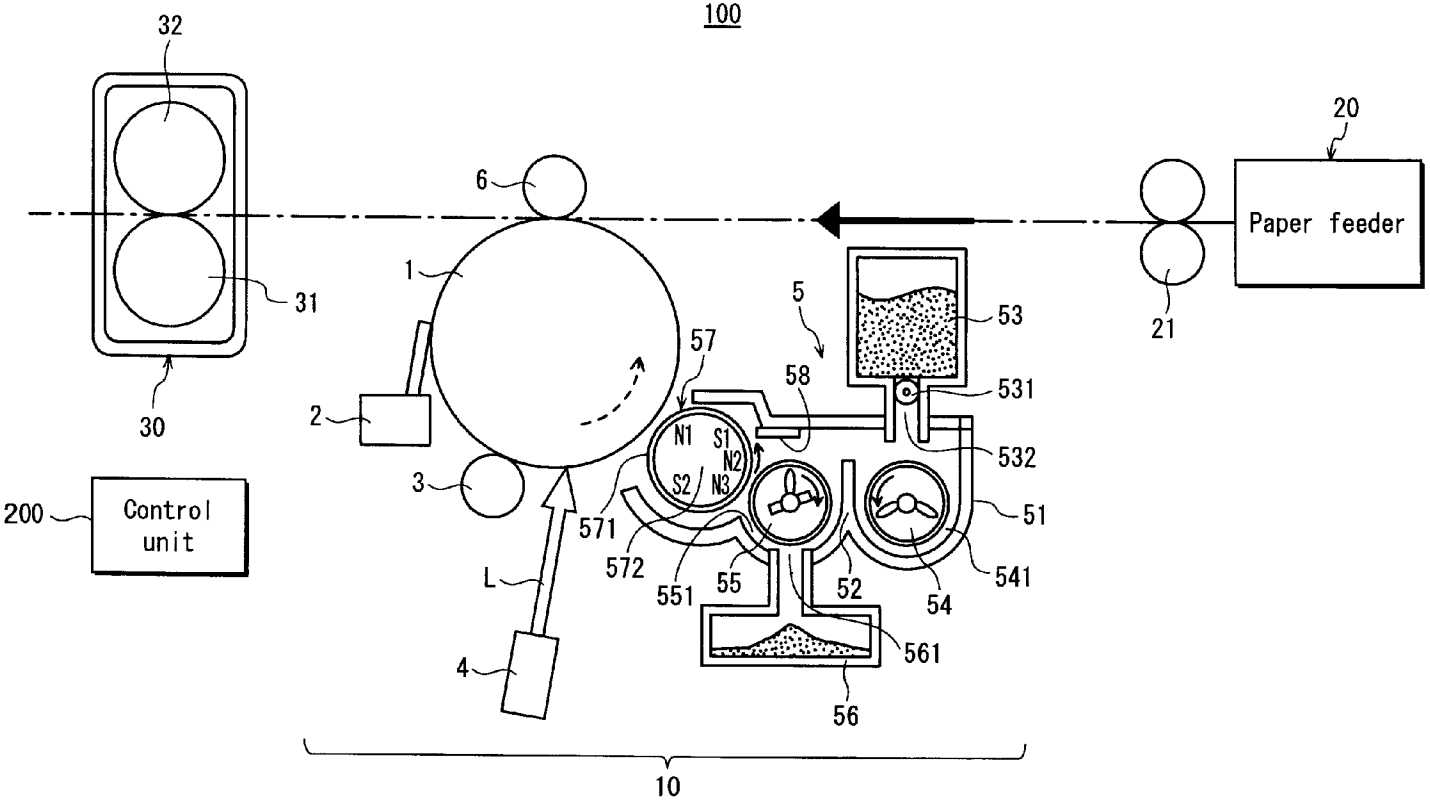
FIG. 1 shows a schematic structure of a printer in an embodiment of the present invention.

FIG. 1 is a schematic diagram showing an overall structure of a printer 100 in this embodiment.

As shown in FIG. 1, the printer 100 includes an imaging unit 10, a paper feeder 20, a fixing unit 30, and a control unit 200.

The imaging unit 10 includes a photosensitive drum 1, a cleaner 2, a charging roller 3, an exposure-scanning unit 4, a developing unit 5, and a transfer roller 6.

According to the imaging unit 10, an outer circumferential surface of the photosensitive drum 1 is cleaned by the cleaner 2 to remove toner remaining thereon, and then uniformly charged by the charging roller 3. Then, the exposure-scanning unit 4 performs exposure-scanning on the photosensitive drum 1 by emitting a laser beam L to form an electrostatic latent image on the outer circumferential surface of the photosensitive drum 1.

The electrostatic latent image formed on the outer circumferential surface of the photosensitive drum 1 is visualized by being provided with toner by a trickle-type developing unit 5 (described later), and thus a toner image is formed.

On the other hand, a recording sheet (not illustrated) fed by the paper feeder 20 is conveyed along a dashed line in FIG. 1 to a transfer position (a position where the photosensitive drum 1 and transfer roller 6 oppose each other with the recording sheet therebetween) at a timing controlled by a timing roller 21. Then, the toner image formed on the outer circumferential surface of the photosensitive drum 1 is transferred onto the recording sheet by the transfer roller 6.

The recording sheet onto which the toner image has been transferred passes through a fixing nip between a fixing roller 31 and a pressure roller 32 in the fixing unit 30, and thus the toner image is fixed onto the recording sheet with heat and pressure. After the toner image is fixed onto the recording sheet, the recording sheet is ejected onto an ejection tray (not illustrated) via an ejection roller 38.

Note that a rotary/fixed brush-type charging device, or a wire electric discharge-type charging device may be used in place of the charging roller 3 in the imaging unit 10. A wire electric discharge-type transfer device or the like may also be used in place of the transfer roller 6. Although the cleaner 2 is described as a plate-like blade in FIG. 1, a rotary/fixed brush-type cleaner or the like may be used in place of the cleaner 2.

The control unit 200 includes a CPU, a communication interface, a ROM, a RAM and so on. Upon receiving an instruction for executing a print job from an external client terminal via the communication interface, the CPU reads out a predetermined program from the ROM and controls the imaging unit 10, the paper feeder 20, the fixing unit 30, and the like to smoothly execute an image forming operation.

In this embodiment, the control unit 200 controls the image forming operation by changing a system speed depending on a sheet type selected by a user. For example, when a plain paper is selected, a high-speed image forming mode (high-speed mode) is performed. On the other hand, when a thick paper or an OHP sheet is selected, a low-speed image forming mode (low-speed mode) is performed.

(2) Structure of Developing Unit 5

The developing unit 5 is a trickle-type developing unit using two-component developer. The developing unit 5 includes a housing 51 as a developing chamber, a stirring screw 54, a supply screw 55, a developing roller 57, and a developer supply tank 53, and a discharged developer collection tank 56. The stirring screw 54, the supply screw 55, and the developing roller 57 are arranged in the housing 51, in parallel with one another in a direction perpendicular to the sheet of FIG. 1 (in Y direction in FIG. 2). The developer supply tank 53 is disposed above the housing 51, and the discharged developer collection tank 56 is disposed below the housing 51.

The developer supply tank 53 stores therein two-component developer including non-magnetic toner (hereinafter, simply referred to as "toner") and magnetic carrier (hereinafter, simply referred to as "carrier"). By rotating a supply roller 531, an appropriate amount of developer is supplied to, via a developer supply port 532, an upstream end portion of a second conveyance passage 541 in the housing 51 (an end portion of the second conveyance passage 541 located at the front side of the sheet of FIG. 1).

In this embodiment, the amount of fresh developer to be supplied is controlled by the control unit 200. A magnetic sensor 59 (see FIG. 2) is provided at the bottom of the second conveyance passage 541 and detects toner density. When the detected toner density is equal to or lower than a predetermined value, the supply roller 531 is driven under control of the control unit 200 so that a predetermined amount of fresh developer is supplied.

A density of carrier in the fresh developer to be supplied is preferably 5 to 40 percent by weight, and more preferably 10 to 30 percent by weight.

On the other hand, developer is discharged little by little from the developer discharge opening 561 provided in a developer discharge passage 513 (see FIG. 2) that extends from a downstream end of the first conveyance passage 551. The discharged developer is collected into the discharged developer collection tank 56.

Note that the developer supply tank 53 and the discharged developer collection tank 56 are configured to be replaceable as necessary.

The developing roller 57 is cylindrical and arranged in parallel with the photosensitive drum 1 with a developing gap therebetween. The developing roller 57 has a structure in which a magnet roller 572 is inserted into a cylindrical developing sleeve 571. The developing sleeve 571 is pivotally supported in the housing 51, whereas the magnet roller 572 is fixed so as not to rotate with respect to the housing 51.

The developing sleeve 571 is driven to rotate in a direction opposite to a direction in which the photosensitive drum 1 rotates (in a counter direction). Above the developing sleeve 571, a regulation plate 58 is arranged so as to be in parallel with an axis of the developing sleeve 571 and to face the developing sleeve 571 with a regulation gap therebetween. The regulation plate 58 regulates the thickness of developer adhering to an outer circumferential surface of the developing sleeve 571 so that developer is not supplied excessively.

The magnet roller 572 inserted into the developing sleeve 571 has five magnetic poles of N1, S2, N3, N2, and S1 arranged in this order in a circumferential direction of the developing sleeve 571. A main magnetic pole N1 in the magnetic poles is arranged so as to face the photosensitive drum 1. The main magnetic pole N1 attracts carrier to the developing sleeve 571, and therefore only toner is supplied to the photosensitive drum 1.

Figure 2:
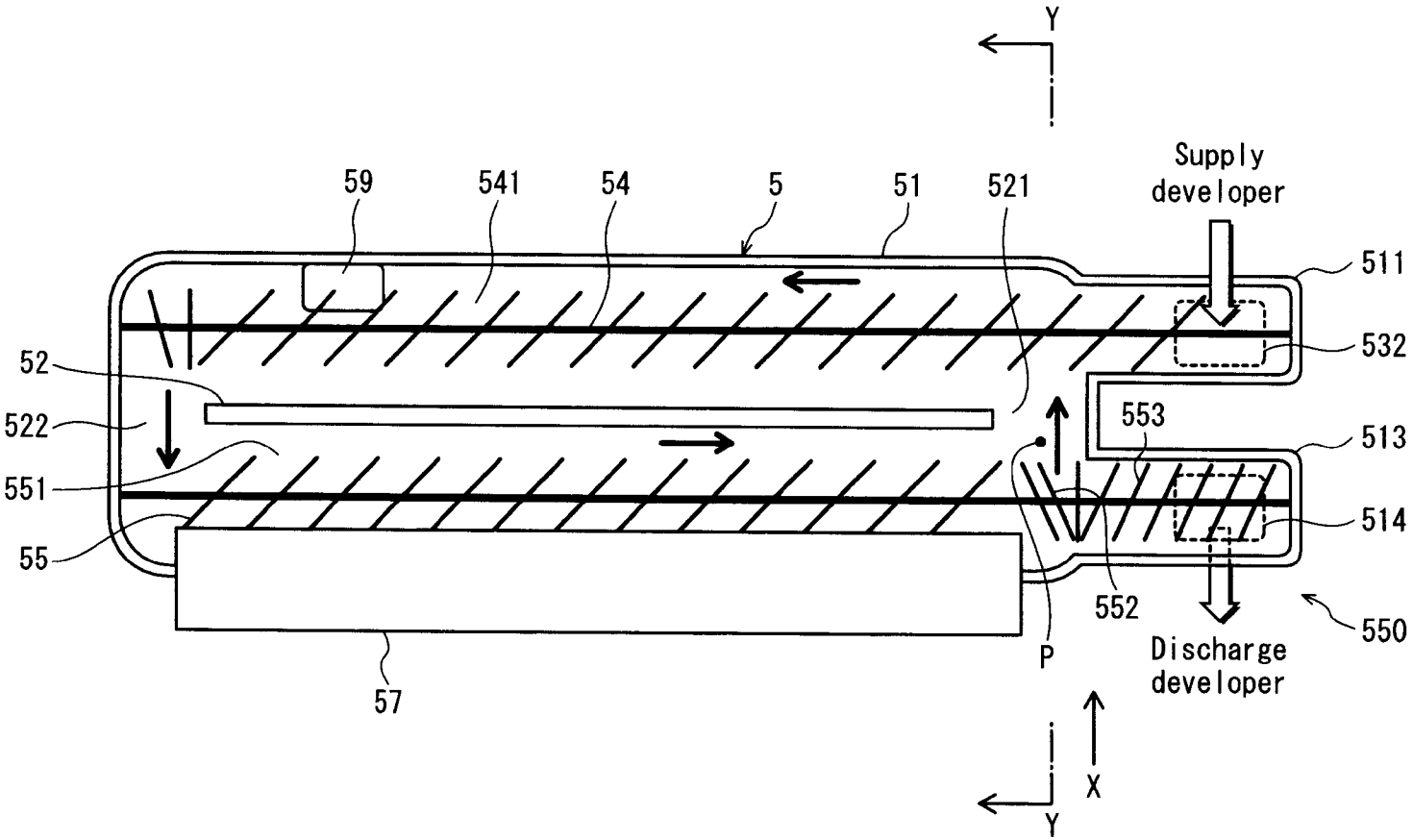
FIG. 2 is a schematic sectional view of a conveyance passage in a developing unit in the printer shown in FIG. 1 as viewed from above.

FIG. 2 is a schematic sectional view of a circular conveyance passage in the developing unit 5 as viewed from above.

As shown in FIG. 2, two screws, namely the supply screw 55 and the stirring screw 54, are arranged in parallel with the developing roller 57 in the housing 51. A partition wall 52 is provided to stand between the supply screw 55 and the stirring screw 54. The partition wall 52 partitions the housing 51 into a first conveyance passage 551 and a second conveyance passage 541. At the bottom of the second conveyance passage 541, a magnetic sensor 59 for detecting the toner density in developer in the second conveyance passage 541 is provided.

Each of the supply screw 55 and the stirring screw 54 is a spiral screw composed of a shaft and a blade helically winding around the shaft with a predetermined pitch.

Both ends of the partition wall 52, i.e. hidden portions of the first conveyance passage 551 and the second conveyance passage 541, are open. At one of the hidden portions where developer conveyed through the first conveyance passage 551 is passed to the second conveyance passage 541, a first communicating portion (communicating passage) 521 is formed.

At the other hidden portion where developer conveyed through the second conveyance passage 541 is passed to the first conveyance passage 551, a second communicating portion (communicating passage) 522 is formed.

A developer supply passage 511 extends from an upstream end portion of the second conveyance passage 541. The developer supply tank 53 (see FIG. 1) provided above the developer supply passage 511 supplies developer via the developer supply port 532.

Each of the supply screw 55 and the stirring screw 54 is driven to rotate by a drive mechanism (not illustrated) so that developer in a conveyance passage is conveyed in a direction of an arrow shown in FIG. 1. Developer arriving at a downstream hidden portion of the first conveyance passage 551 is passed to the second conveyance passage 541 through the first communicating portion 521, whereas developer arriving at a downstream hidden portion of the second conveyance passage 541 is passed to the first conveyance passage 551 through the second communicating portion 522. As a result, developer is conveyed so as to circulate in a circulation passage made up of the first conveyance passage 551 and the second conveyance passage 541. When conveyed in the first conveyance passage 551, developer is supplied to an outer circumferential surface of the developing roller 57 that faces the first conveyance passage 551.

A developer discharge passage 513 extends from a downstream end portion of the first conveyance passage 551.

A reverse screw 552 is connected to the supply screw 55 at a position corresponding to the first communicating portion 521 for connecting the first conveyance passage 551 and the second conveyance passage 541 and at a position corresponding to a downstream hidden portion of the first conveyance passage 551 (in the developer discharge passage 513). The reverse screw helically winds in a reverse direction and has a pitch smaller than that of the supply screw 55 in the first conveyance passage 551.

In the developer discharge passage 513, a discharge screw 553 is formed around the same shaft as that of the supply screw 55. The discharge screw 553 helically winds in the same direction as a direction in which the supply screw 55 winds and has a pitch smaller than that of the supply screw 55.

The developer discharge passage 513, the reverse screw 552, the discharge screw 553, and a developer collection opening 514 (see FIG. 1) constitute a trickle discharge mechanism 550 as a whole.

Figure 3:
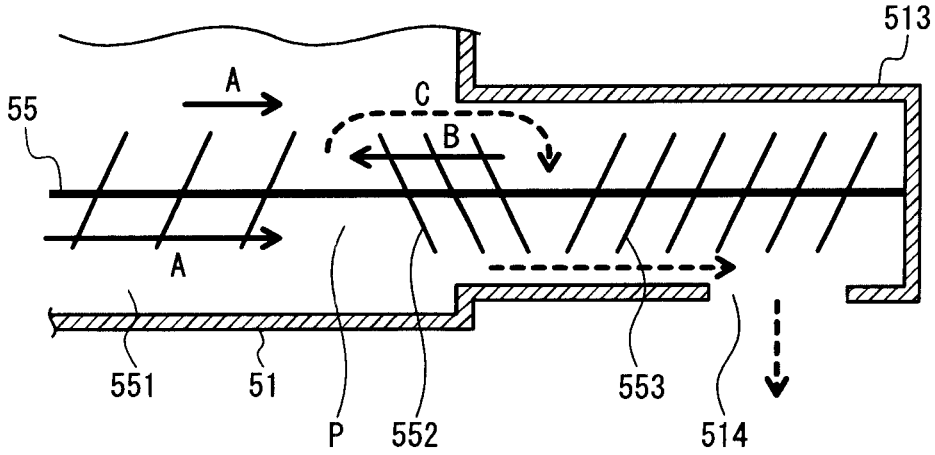
FIG. 3 is a schematic sectional view showing a structure of the developing unit shown in FIG. 2 at the junction between a first conveyance passage and a developer discharge passage.

FIG. 3 is a schematic sectional view showing an area P (the junction between the first conveyance passage 551 and the developer discharge passage 513, and hereinafter is referred to as a "junction P") located downstream of the first conveyance passage 551 when viewed in a direction of an arrow X shown in FIG. 2.

Developer conveyed by the supply screw 55 is normally blocked by the reverse screw 552, and therefore much of the developer is conveyed to the second conveyance passage 541 through the first communicating portion 521 (see FIG. 2).

When the surface level of developer rises in the developing chamber due to an increase in the amount of developer in the housing 51, a surface level of developer at the junction P also rises. Then, developer flowing against the blocking action of the reverse screw 552 overcomes the reverse screw 552 as shown by an arrow C shown in FIG. 3 and overflows into the developer discharge passage 513 next to the reverse screw 552.

The excessive amount of developer overflowing into the developer discharge passage 513 is conveyed to the developer collection opening 514 by the discharge screw 553, and collected (discarded) in the discharged developer collection tank 56 (see FIG. 1).

Figure 4A:
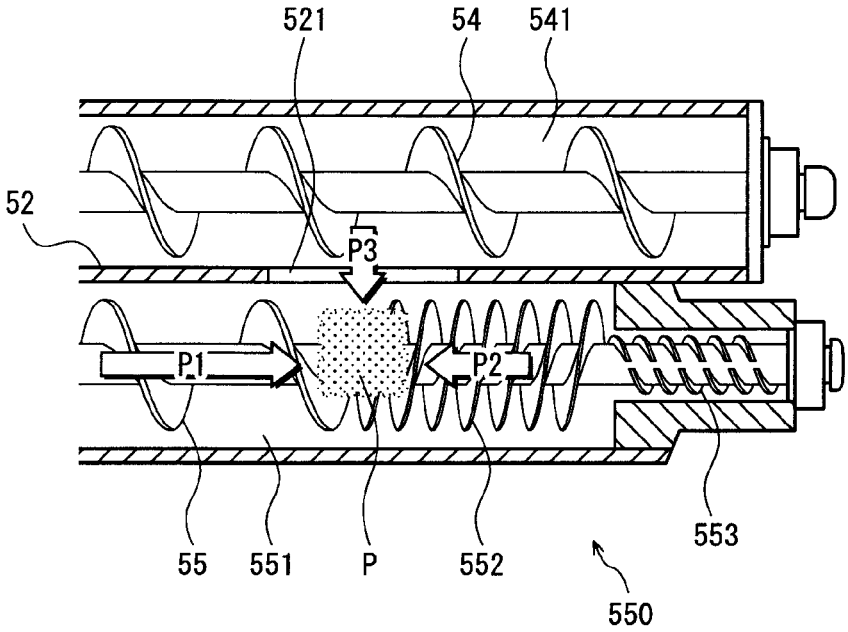
FIG. 4A schematically shows a relation among pressures applied to developer in the vicinity of a trickle discharge mechanism at a downstream end portion of the first conveyance passage in the developing unit shown in FIG. 2, and FIG. 4B schematically shows a flow of developer in the same vicinity.
Figure 4B:
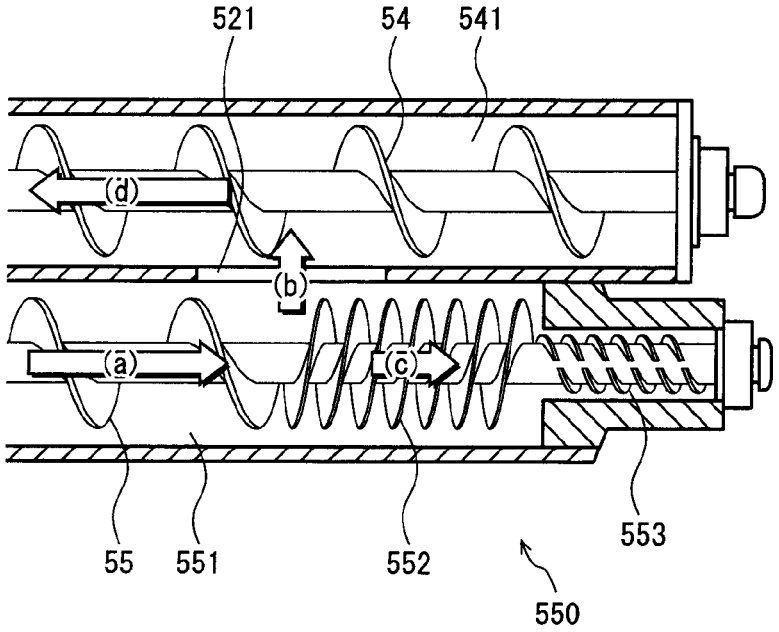

The following describes the structure and the principle of the trickle discharge mechanism 550 in more detail with use of FIGS. 4A and 4B. FIG. 4A shows a relation among pressures applied to developer in the vicinity of the first communicating portion 521 at the junction P (strictly speaking, an area located downstream of the first conveyance passage 551 and an area located upstream of the trickle discharge mechanism 550). FIG. 4B shows a flow of developer in the same vicinity.

At the junction P, there are two pathways through which developer flows. One is a pathway (a main circulation pathway) through which developer flows from the first conveyance passage 551 to the second conveyance passage 541 via the first communicating portion 521 (arrow directions (a)→(b)→(d) in FIG. 4B). The other is a pathway (a discharge pathway) through which developer is discharged from the first conveyance passage 551 to an outside of the developing chamber via the trickle discharge mechanism 550 (arrow directions (a)→(c) in FIG. 4B).

The proportion of the amount of developer overflowing into the developer discharge passage 513 to the amount of developer conveyed by the supply screw 55 changes depending on pressures applied at the junction P.

As shown in FIG. 4A, the following three pressures P1 to P3 are applied to developer at the junction P.

P1: Pressure applied by the supply screw 55 to convey developer downstream in the first conveyance passage 551.

P2: Pressure applied by the reverse screw 552 to convey developer in the opposite direction.

P3: Resistance against developer flowing through the opening of the first communicating portion 521 (hereinafter, referred to as "flow resistance").

As described above, much of the developer is conveyed to the second conveyance passage 541 through the first communicating portion 521 (the main circulation pathway). Part of the developer, however, resists against the pressure P2 applied by the reverse screw 552, overcomes the reverse screw 552, and discharged from the developer collection opening 514 to an outside of the developing chamber (the discharge pathway).

That is to say, whether developer flows into the discharge pathway or the main circulation pathway is determined by balance among the pressures P1, P2, and P3 applied at the junction P.

The pressure P3 applied due to the flow resistance in the first communicating portion 521 is normally set to be extremely low in developing devices other than a trickle-type developing device. In some cases, a paddle mechanism and the like for increasing a force to pass the developer is provided in such a developing device.

This is because of the following reason. If the developer does not flow through the first communicating portion 521 efficiently, an accumulation of developer can be caused at a downstream end of a screw by the pressures P1 and P2. This can destroy balance of the amount of developer in the entire developing device, and lead to negative effects like reduction in toner dispersion efficiency and uneven development due to unevenness of the amount of developer supplied to the developing roller.

In the trickle-type developing device, however, when the pressure P3 applied due to the flow resistance in the first communicating portion 521 is extremely low, the amount of discharged developer determined by the balance between the pressures P1 and P2 tends to be unstable because of various error factors (see experimental results described below).

Therefore, it is desirable to increase the flow resistance to some extent by determining an appropriate size of an opening in the first communicating portion 521.

In particular, when the flow resistance in the first communicating portion 521 at a downstream end portion of the supply screw 55 increases to some extent while suppressing the flow resistance in the second communicating portion 522 at a downstream end portion of the stirring screw 54, a larger amount of developer is ensured in the first conveyance passage 551 than in the second conveyance passage 541. Even when a total amount of developer is temporarily reduced, a certain amount of developer is ensured in the first conveyance passage 551 in which the supply screw 55 is housed, and therefore negative effects like uneven development due to unevenness of the amount of developer supplied to the developing roller are inhibited. Therefore, this structure is suitable for the trickle-type developing device.

(3) Valve Mechanism

The main purpose of the present invention is, when the pressure P1 applied downstream by the forward screw and the pressure P2 due to a wall surface in a downstream hidden portion of the first conveyance passage 551 and the reverse screw fluctuate depending on various error factors, to maintain the balance among the pressures P1, P2, and P3 by adjusting the flow resistance P3 in the first communicating portion 521. This maintains balance between the amount of developer flowing in the discharge pathway and that in the main circulation pathway. As a result, the amount of developer in the developing chamber is maintained within the acceptable range with respect to various error factors.

In order to achieve the above-mentioned purpose, an opening of the first communicating portion 521 is configured to change autonomously in size depending on pressures applied to developer at the junction P in this embodiment. The amount of developer flowing through the opening per unit time changes accordingly. Specifically, a valve mechanism that bends in response to the pressures applied to developer at the junction P is provided at the opening of the first communicating portion 521.

Figure 5A:
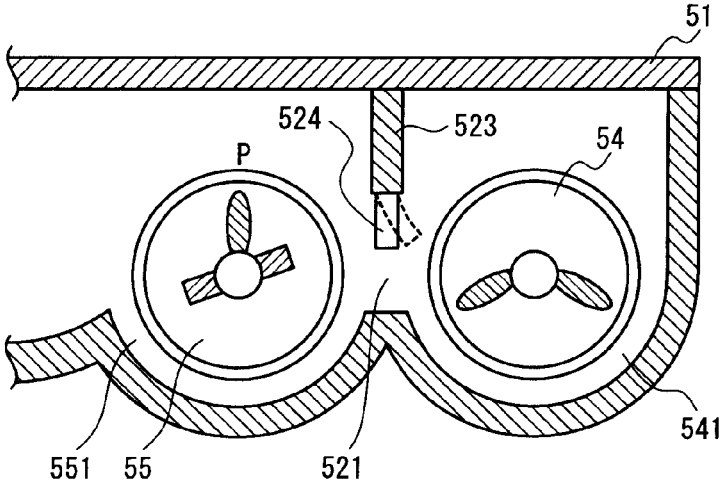
FIG. 5A shows a structure of an opening of a first communicating portion that connects a downstream end portion of the first conveyance passage and an upstream end portion of a second conveyance passage in a developing unit in the embodiment.

FIG. 5A is a sectional view showing a structure of the valve mechanism in this embodiment taken along the line Y-Y of FIG. 2. In FIG. 5A, only main parts are described, and therefore the developing roller 57 and so on are omitted.

Figure 5B:
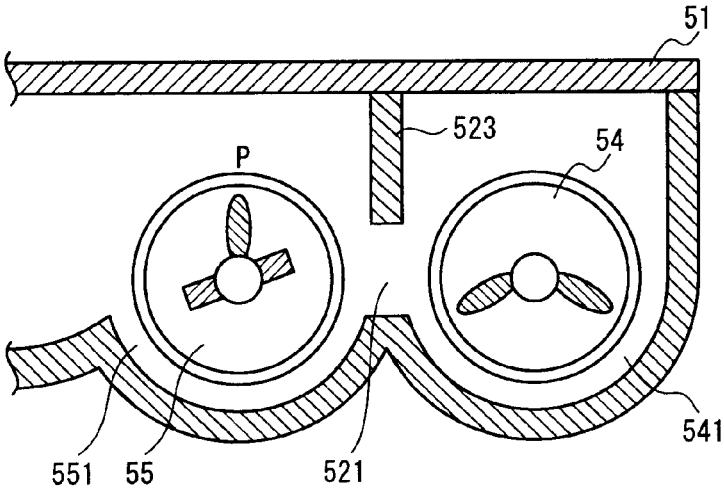
FIG. 5B shows a conventional structure of the opening.
Figure 5C:
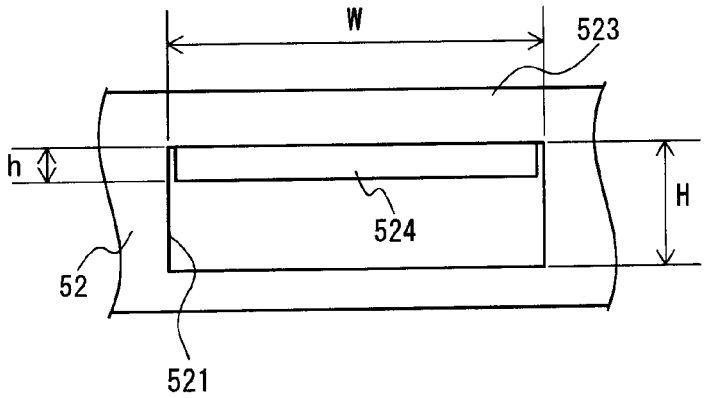
FIG. 5C shows an overall shape of the opening shown in FIG. 5A.

FIG. 5C shows the first communicating portion 521 when viewed in a direction of an arrow X shown in FIG. 2.

As shown in FIG. 5A, a valve 524 is attached along a part of the partition wall 52 above the opening of the first communicating portion 521 (hereinafter, the part is referred to as a partition wall edge 523).

The valve 524 is made of a flexible material such as a foamed elastic material. In this embodiment, the valve is made of urethane foam covered with a resin film (a PET film in this embodiment). As shown in FIG. 5C, the length of the valve 524 is approximately the same as the width W of an upper edge of the opening of the first communicating portion 521.

The valve 524 may be fixed to the partition wall edge 523 in the first communicating portion 521 with an adhesive, or may be formed in another manner. For example, the valve 524 and the partition wall edge 523 may be integrally made by using an insert molding method, according to a material thereof.

When the pressure applied to developer increases at the junction P, the valve 524 bends as shown by a broken line in FIG. 5A. Accordingly, the opening of the first communicating portion 521 increases in size, and thus the amount of developer flowing through the opening per unit time increases. As a result, the flow resistance is reduced, and the increase of the pressure applied at the junction P is eased.

FIG. 5B shows an example of a conventional structure of the opening corresponding to the first communicating portion 521 in this embodiment that is used to conduct a comparison experiment for examining a stable amount of developer in the developing chamber. The valve 524 shown in FIG. 5A is not provided at the opening having the conventional structure, and a size of the opening having the conventional structure is approximately the same as that of the opening shown in FIG. 5A in a state where the valve 524 does not change in shape.

(4) Evaluation Experiment

Figure 6A:
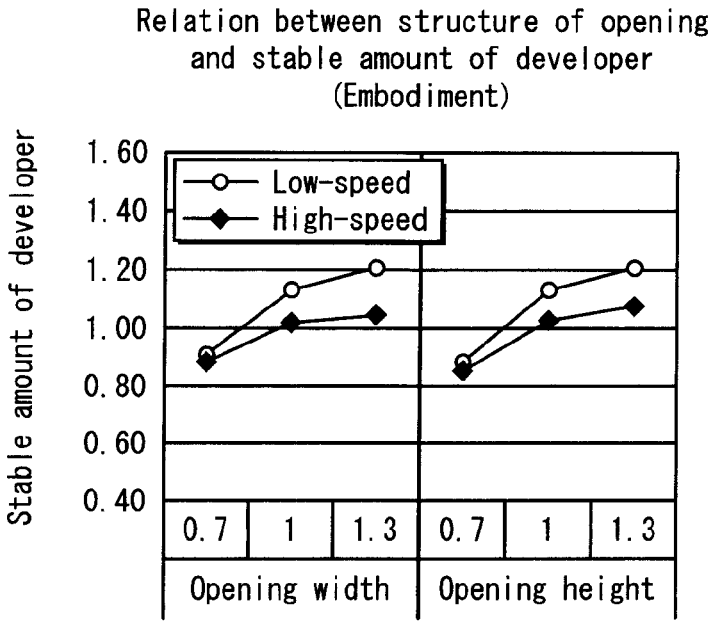
FIG. 6A is a graph showing experimental results on relations between the structure of the opening of the first communicating portion in the embodiment and a stable amount of developer.
Figure 6B:
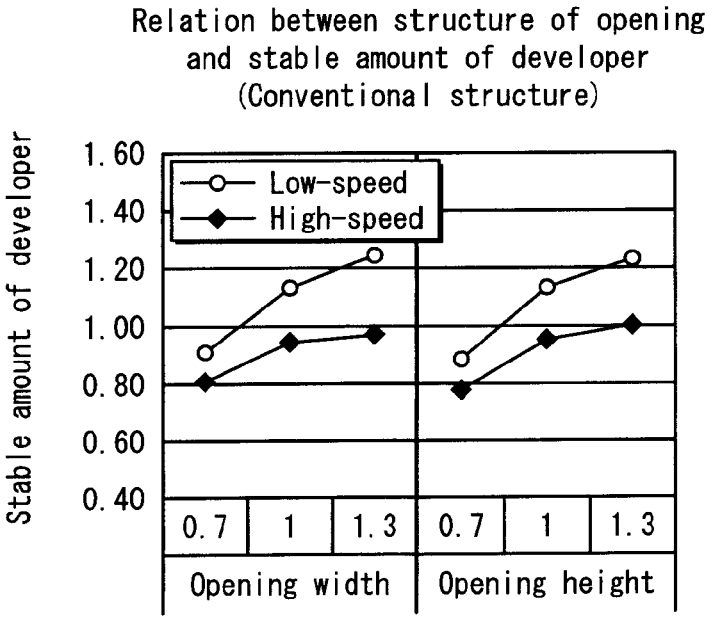
FIG. 6B is a graph showing experimental results on relations between the structure of the opening in the conventional technology and a stable amount of developer.

Evaluation experiment was conducted to examine a stable amount of developer remaining in the developing chamber in high-speed driving and in low-speed driving, using the above-mentioned structure in this embodiment and the conventional structure. Results of the experiment are shown in FIGS. 6A and 6B.

Conditions of the experiments are as follows:

System speed in low-speed driving: 108 mm/sec

System speed in high-speed driving: 325 mm/sec

Rotational speed of the supply screw 55 in high-speed driving: 500 rpm

Rotational speed of the supply screw 55 in low-speed driving: 166 rpm

Pitch of the supply screw 55: 30 mm

Diameter of the supply screw 55: 16 mm

Pitch of the reverse screw 552: 5 mm

Number of turns of the reverse screw 552: 2.5 times

Diameter of the reverse screw 552: 16 mm

Opening height H of the first communicating portion 521: 15 mm

Opening width W of the first communicating portion 521: 15 mm

Height h of the valve 524: 5 mm

Thickness d of the valve 524: 1.5 mm

Temperature in the device: 20 degrees Celsius, Humidity in the device: 50 percent Note that, in this experiment, the opening height H and opening width W of the first communicating portion 521, and the height h and thickness d of the valve 524 are determined such that the stable amount of developer remaining in the developing chamber shows a designed appropriate value in high-speed driving using a plain paper.

In order to examine a relation between the stable amount of developer and a size of the opening, experiments were also repeatedly conducted by decreasing the opening width or opening height of the first communicating portion 521 shown above (hereinafter, referred to as a "standard opening width or height") by 0.7 times and by increasing the opening width or opening height of the first communicating portion 521 by 1.3 times.

FIG. 6A is a graph showing results of the experiments conducted using the structure in this embodiment shown in FIG. 5A. FIG. 6B is a graph showing results of the experiments conducted using the conventional structure shown in FIG. 5B.

Each value of the horizontal axis shows a ratio of an opening width or opening height to the standard opening width or height. For example, when "opening width" is "1.3", the opening height is the same as the standard height, and the opening width is 1.3 times larger than the standard width.

Each value of the longitudinal axis shows a ratio of a stable amount of developer remaining in the developing chamber to the most desirable amount of developer remaining in the developing chamber. Therefore, the closer the ratio is to "1", the less likely the uneven development is to occur.

According to the results of the experiments conducted using the conventional structure shown in FIG. 6B, the stable amount of developer remaining in the developing chamber in low-speed driving is larger than that in high-speed driving. This is because, in low-speed driving, the pressure applied to developer decreases at the junction P, and therefore the amount of discharged developer becomes small.

Specifically, in low-speed driving, both of the pressure P1 applied by the forward screw and the pressure P2 applied by the reverse screw in the reverse direction are low. Therefore, developer is more likely to flow into the second conveyance passage 541 through the opening of the first communicating portion 521, rather than overcoming the reverse screw 552 and flowing into the developer collection opening 514. On the other hand, in high-speed driving, the pressure applied to developer at the junction P increases. Therefore, a larger amount of developer overcomes the reverse screw 552 and flows into the developer collection opening 514.

As shown in the graph of FIG. 6B, when the opening width W or opening height H is increased by 1.3 times to reduce the resistance (flow resistance) against developer flowing through the opening of the first communicating portion 521, a difference in the stable amount of developer between high-speed driving and low-speed driving becomes marked.

On the other hand, when the valve 524 is provided at the opening of the first communicating portion 521 as shown in this embodiment, as shown in FIG. 6A, a difference in the stable amount of developer between high-speed driving and low-speed driving becomes smaller than that in the conventional structure shown in FIG. 6B.

This is because of the following reason. In this embodiment, when the pressure applied to developer increases at the junction P in high-speed driving, the valve 524 bends toward the second conveyance passage 541 as shown by the broken line in FIG. 5A, and thus the opening of the first communicating portion 521 increases in size. Accordingly, the flow resistance is reduced, and the pressure applied to developer at the junction P is eased. However, when the pressure applied to developer decreases at the junction P due to a decrease in conveyance force of the supply screw 55 in low-speed driving, the valve 524 attempts to return to the original state, and the opening of the first communicating portion 521 decreases in size. Accordingly, the flow resistance is increased, and the pressure applied to developer increases.

That is, in high-speed driving, the pressure applied to developer at the junction P increases. However, the valve 524 provided at the opening changes in shape in response to the increased pressure. In this case, the resistance of the communicating portion is reduced compared with a case of the conventional structure under the same condition. Therefore, the amount of developer flowing to the second conveyance passage 541 through the first communicating portion 521 increases. As a result, the stable amount developer increases compared with a case shown in FIG. 6B.

On the other hand, the valve 524 is less likely to change in shape in low-speed driving, because the pressure applied to developer is low. The opening in low-speed driving is approximately the same in size as that of the conventional structure shown in FIG. 5B. Therefore, the stable amount of developer in low-speed driving is approximately the same as that shown in FIG. 6B.

As a result, a difference in the pressure applied to developer at the junction P between high-speed driving and low-speed driving becomes small, and the amount of discharged developer is kept relatively constant. The stable amount of developer remaining in the developing chamber does not greatly change.

In this embodiment, the stable amount of developer is kept relatively constant when the change in driving speed of the developing device, which is one of factors leading to fluctuations of pressure applied to developer (error factors), occurs. As shown above, the amount of developer is kept relatively constant by reducing the temporary fluctuations of pressure applied to developer in a trickle mechanism that controls discharge and circulation of developer utilizing the pressure applied to developer. The structure in this embodiment also has an effect of keeping the amount of developer relatively constant without being affected by temporary and partial fluctuations of pressure applied to developer lead by other error factors, such as toner density, deterioration of carrier, a change in fluidity of developer due to a change in use environment, vibration and a tilt of a device, pulsation of developer during conveyance of developer.

Therefore, as long as the other error factors exist, the structure in this embodiment is applied to even an image forming apparatus that does not change the driving speed.

(5) Modifications

Although the present invention has been described based on the embodiment, it is obvious that the present invention is not limited to the above-mentioned embodiment, and various modifications may be implemented.

In particular, a mechanism for adjusting the flow resistance in the first communicating portion 521 may have any structure as long as a size of the opening of the first communicating portion 521 is changed in response to the pressure applied to developer at the junction P by the mechanism. For example, the following modifications may be implemented.

Figure 7A:
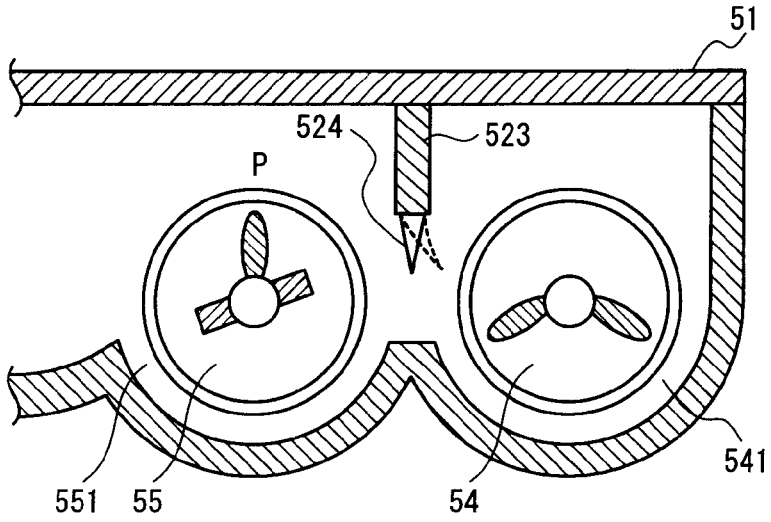
FIG. 7A shows a structure of a valve provided at the opening of the first communicating portion in first modification.

(5-1) FIG. 7A shows, as first modification of the valve 524 in the embodiment, the valve 524 having a tapered portion that tapers toward a tip so that the tapered portion is wide at a base (a portion where the valve 524 is fixed to the partition wall edge 523) and tapers at a tip.

The valve 524 in first modification is characterized by having the tapered portion that is formed by sticking resin films (PET films in first modification) each having a thickness of 0.05 mm in layers in such a manner that the number of films stuck in layers is larger at a base than at a tip.

The height and width of the valve 524 in first modification are 5 mm and 15 mm, respectively. The thickness of the valve 524 at a base is 0.5 mm.

Figure 7B:
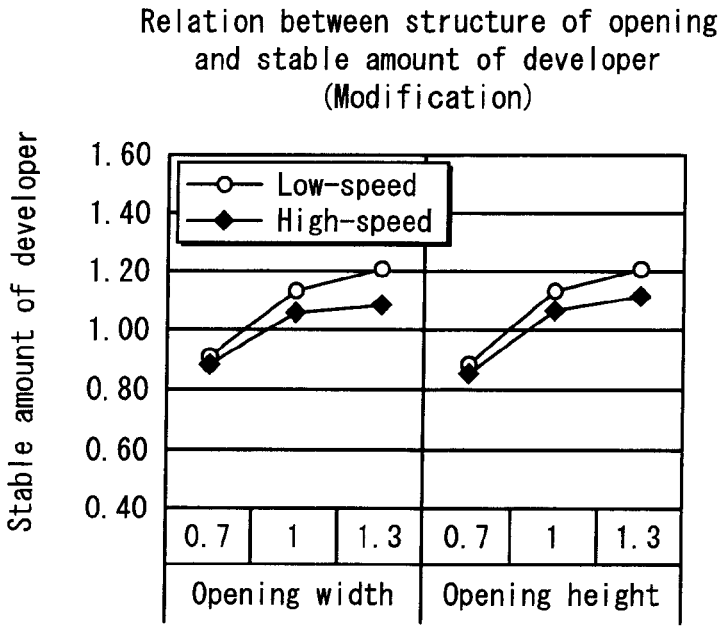
FIG. 7B is a graph showing experimental results on relations between the structure of the opening in first modification and a stable amount of developer.

FIG. 7B is a graph showing results of the same experiments conducted using the valve 524 in first modification.

As can be seen from the experimental results shown in FIGS. 7B and 6A, when the valve 524 in first modification is used, a difference in the stable amount of developer between high-speed driving and low-speed driving becomes smaller than that in the embodiment shown in FIG. 5A. The amount of developer remaining in the developing chamber is kept more constant accordingly, and therefore uneven development is less likely to occur.

In particular, as the valve 524 tapers toward a tip, flexibility of the valve 524 increases. Therefore, the flow resistance in high-speed driving is lower than that in the case shown in FIG. 5A, and a large amount of developer flows to the main circulation pathway rather than flowing into the discharge pathway. As a result, the stable amount of developer in high-speed driving increases as shown in FIG. 7B, and a difference in the stable amount of developer between high-speed driving and low-speed driving becomes small.

Therefore, by setting the opening width W and the opening height H of the first communicating portion 521, and a material and dimensions of the valve 524 so that the stable amount of developer shows "1" in high-speed driving, it is possible to obtain a desirable developing device that keeps the amount of developer relatively constant without being affected by the pressure fluctuations.

According to first modification, the following advantageous effect can further be obtained.

That is, when the valve 524 having a tapered portion that tapers toward a tip as shown in FIG. 7A is used, the valve 524 changes in shape easily at a tip. Therefore, the valve 524 is highly responsive to the pressure even when the pressure applied to developer at the junction P is in a low range. On the other hand, when the pressure applied to developer at the junction P is in a high range, a change in flow resistance is reduced, and when the pressure is equal to or higher than a predetermined value, the flow resistance is saturated effectively.

This structure enables the following control over the flow of developer. When an average pressure applied to developer at the junction P is low (when there is a small amount of developer etc.), a larger amount of developer is conveyed to the second conveyance passage 541 compared with a case where the valve 524 having a constant flexibility at a tip and at a base as shown in FIG. 5A is used. On the other hand, when an average pressure applied to developer at the junction P is high (when there is a large amount of developer etc.), developer is conveyed to the developer discharge passage more aggressively.

According to first modification, the valve 524 appropriately changes in shape in response to the pressure fluctuating due to error factors such as a change in driving speed, and thus the amount of developer remaining in the developing chamber is kept relatively constant. In addition, when the pressure applied to developer at the junction P increases extremely due to a significant increase in the amount of developer remaining in the developing chamber, discharge of developer from the developer collection opening 514 is enhanced, and developer is prevented from overflowing from the housing 51. Therefore, the amount of developer is promptly reduced so as to fall within an appropriate range. When the pressure applied to developer is low due to a shortage of developer, the valve 524 changes in shape easily in response to subtle pressure fluctuations. The valve 524 helps to keep the amount of developer relatively constant.

By using the valve 524 having the tapered portion as a mechanism for adjusting the flow resistance, the flow resistance is adjusted appropriately in response to fluctuations of pressure applied to developer lead by various factors. When the pressure applied to developer changes momentarily in the vicinity of the first communicating portion 521, discharge and circulation of developer is controlled according to an average pressure applied to developer. Therefore, the amount of developer is kept relatively constant according to conditions.

Note that the tapered portion does not need to be formed in the entire height of the valve 524. Even when the tapered portion is formed in a part of the height of the valve 524, some effects described above are obtained.

The valve 524 in first modification is not limited to have the tapered portion shown in FIG. 7A, which is formed by sticking resin films in layers. For example, the valve 524 may be formed by using an elastic member that is triangular in cross-section. Alternatively, the valve 524 may be formed by sticking, in a height direction, a plurality of elastic members each being made of a different material (having a different elasticity) so that the valve 524 is more flexible at a tip than at a base.

That is to say, the above-mentioned effects are obtained as long as the valve 524 has a portion, in the height direction, that becomes more flexible closer toward a tip.

Figure 8:
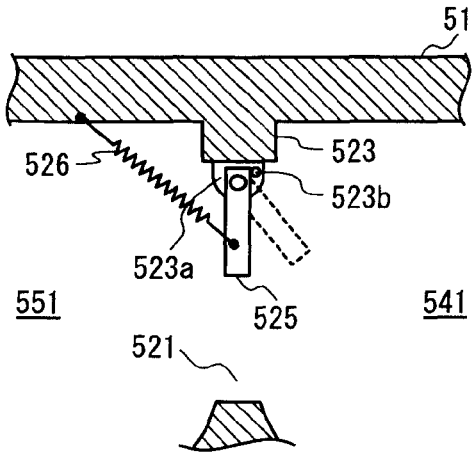
FIG. 8 shows a structure of a valve provided at the opening of the first communicating portion in second modification.

(5-2) In the above-mentioned embodiment, the flexible valve 524 is used as a mechanism for adjusting the flow resistance in the first communicating portion 521, but the structure shown in FIG. 8 may be applied as the mechanism. In FIG. 8, a shutter 525 is swingably supported by a supporter 523*a* attached to the partition wall edge 523. An extension spring 526 is configured to apply a force so as to swing the shutter toward the first conveyance passage 551.

In this case, a mechanism (a swing prohibiting mechanism) for inhibiting the shutter 525 from swinging toward the first conveyance passage 551 further than a position shown by a solid line in FIG. 8 (a position where the opening of the first communicating portion 521 is maximally blocked by the shutter 525) is required. In this modification, a pin 523*b* is provided so as to stand on the supporter 523*a*.

With this structure, the above-mentioned effects obtained in the embodiment are also obtained by appropriately determining the height of the shutter 525 and a coefficient of the extension spring 526.

(5-3) Instead of using the above-mentioned flexible valve, it is possible to adjust the flow resistance by using a drive mechanism described below.

(5-3-1) In particular, the most significant factor that affects the pressure fluctuations at the junction P is a change in a driving speed. The following describes another modification of a mechanism for adjusting the flow resistance in the first communicating portion 521 focusing on the factor.

Figure 9:
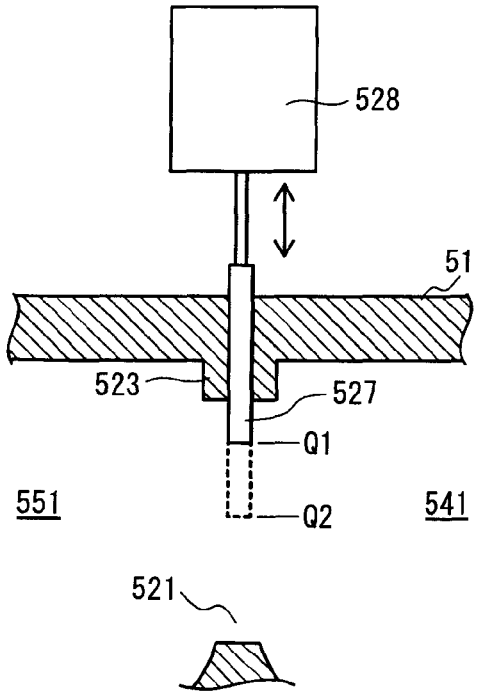
FIG. 9 shows a structure of a valve provided at the opening of the first communicating portion in third modification.

FIG. 9 shows a structure of a flow resistance adjusting mechanism in third modification.

As shown in FIG. 9, in third modification, a plate-like shutter 527 is attached to the partition wall edge 523 so as to be moved in a direction shown by an arrow with respect to the first communicating portion 521 by an appropriate actuator such as a solenoid 528. With this structure, the opening of the first communicating portion 521 changes in size and the flow resistance is changed accordingly.

The opening of the first communicating portion 521 is controlled so as to change in size. That is, in high-speed driving, the shutter 527 is moved up to a first position Q1 shown by a solid line in FIG. 9. On the other hand, in low-speed driving, the shutter 527 is moved down to a second position Q2 shown by a broken line in FIG. 9.

Figure 10:
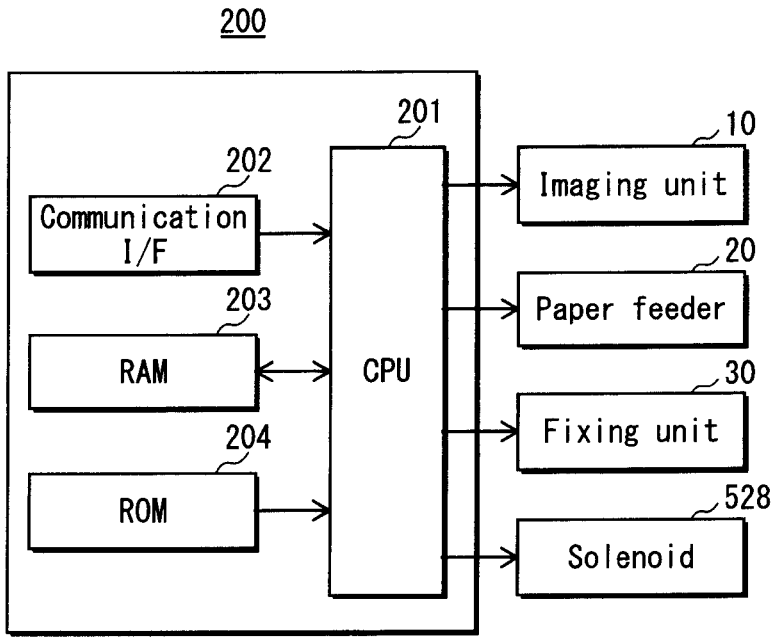
FIG. 10 shows a structure of a control unit in third modification.

FIG. 10 is a block diagram showing a structure of the control unit 200 in this case.

As shown in FIG. 10, the control unit 200 includes a CPU 201, a communication I/F (interface) 202, a RAM 203, a ROM 204, and so on.

The communication I/F 202 is a LAN card or a LAN board for connecting an external client terminal with a LAN. The communication I/F 202 receives print job data transmitted from the client terminal via the LAN, and transmits the received data to the CPU 201.

The RAM 203 is a volatile memory. The RAM 203 is a work area during program execution by the CPU 201.

In the ROM 204, a program for controlling operations performed by each unit in the image forming apparatus 100 is stored.

Based on acquired image data, the CPU 201 reads out a necessary program from the ROM 204, and coordinately controls operations performed by the imaging unit 10, the paper feeder 20, and the fixing unit 30 while adjusting a timing to perform the image forming operation smoothly. In addition, the CPU 201 drives the solenoid 528 to move the shutter 527 up or down, and changes the flow resistance in the first communicating portion 521.

Figure 11:
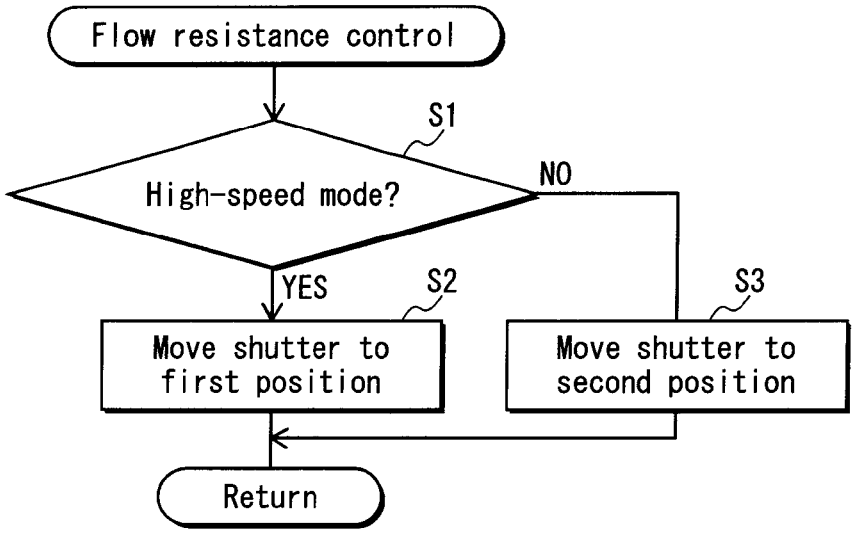
FIG. 11 is a flowchart showing a flow resistance control processing performed by the control unit shown in FIG. 10.

FIG. 11 is a flowchart showing a flow resistance control processing performed by the control unit 200. The flow resistance control processing is performed at the start of the image forming operation as a subroutine in a main flowchart (not illustrated) showing an entire operation in the printer 100.

First of all, whether or not a mode for image formation is set to a high-speed mode is determined. In this modification, for example, the control unit 200 is programmed to perform the high-speed mode when a plain paper is used, whereas to perform the low-speed mode when a thick paper or an OHP sheet is used. A type of sheet contained in each paper feeding cassette in the paper feeder 20 is registered. Upon receiving an input for selecting a paper feeding opening by a user, the control unit 200 determines whether to perform the high-speed mode or the low-speed mode. A speed mode may be directly selected by a user, of course.

When the mode is set to the high-speed mode (Yes in step S1), the control unit 200 controls the solenoid 528 to move the shutter 527 up to the first position Q1 in step S2 in order to respond to the high-speed driving.

When the mode is not set to the high-speed mode (No in step S1), the control unit 200 controls the solenoid 528 to move the shutter 527 down to the second position Q2 in step S3 in order to respond to the low-speed driving.

Then, a processing returns to the main flow chart.

(5-3-2) In modification described in the section (5-3-1), an operation of the solenoid 528 is controlled in accordance with a driving speed to change the flow resistance. For example, however, the movement of the shutter 527 may be controlled in accordance with an output from a well-known pressure sensor that is provided at an appropriate location in the vicinity of the junction P.

In this modification, it is desirable to select an actuator capable of driving the shutter 527 in several steps or in sequence, such as a cam mechanism, and a screw mechanism. With such an actuator, it becomes possible to finely adjust the flow resistance considering not only a speed mode but also other error factors.

The control unit may be configured to detect a temporary change in an output from the pressure sensor. A table showing a relation between the detected change and a size of the opening of the first communicating portion 521 that the stable amount of developer approaches a standard value is preliminarily acquired by an experiment. The table is stored, in the ROM, in advance. The CPU controls the actuator to move the shutter 527 with reference to the above-mentioned table based on the output from the pressure sensor so as to optimize the size of the opening.

Here, the temporary change in an output from the pressure sensor is acquired, for example, by sampling the output from the pressure sensor at a constant frequency, and then by calculating a difference from a value previously detected or differentiating the sampling values with time.

(5-3-3) The following modification may also be implemented in response to fluctuations of the pressure applied to developer lead by error factors other than the change in driving speed.

For example, the fluidity of developer changes depending on environmental conditions of the apparatus. This affects the pressure applied to developer. Specifically, the fluidity of developer tends to be high and thus the pressure applied to developer tends to be low at low temperature and low humidity. On the other hand, the fluidity of developer tends to be low and thus the pressure applied to developer tends to be high at high temperature and high humidity.

Therefore, the control unit 200 may control a size of the opening of the first communicating portion 521 by using the drive mechanism shown in the above modification based on a value output from an environmental sensor that measures the temperature and humidity of the environment surrounding the developing unit.

More specifically, a relation between the value output from the environmental sensor and the pressure applied to developer is determined in advance by experiment and so on. In order to reduce pressure fluctuations, a table showing a relation between a desirable size of the opening of the first communicating portion 521 and the value output from the environmental sensor is stored in the ROM. The CPU drives the actuator to move the shutter 527 based on the value output from the environmental sensor with reference to the table, and thus adjusts the size of the opening of the first communicating portion 521, and reduces the pressure fluctuations at the junction P.

The volume density of developer changes depending on the toner density, and this imposes the pressure fluctuations. Therefore, it is also possible to adjust the flow resistance by changing a size of the opening of the first communicating portion 521 based on a value output from the magnetic sensor 59.

Also in this case, a relation between the value output from the magnetic sensor and the pressure applied to developer is determined in advance by experiment and so on. In order to reduce the pressure fluctuations, a table showing a relation between a desirable size of the opening of the first communicating portion 521 and the value output from the environmental sensor is stored in the ROM. The CPU drives the actuator to adjust the size of the opening of the first communicating portion 521 based on the value output from the magnetic sensor with reference to the table, and thus reduces the pressure fluctuations at the junction P.

Furthermore, the temporary and partial change in the volume of developer and the pressure applied to developer is lead by vibration of the developing unit, a tilt of the conveyance passage in the developing unit, pulsation of developer during conveyance of developer and so on. In order to control the pressure fluctuations at the junction P more accurately, it is required to detect these factors and to adjust the flow resistance based on a table created in advance by using the detected values.

As shown in modifications in the sections (5-3-1) to (5-3-3), the aim of the present invention is also achieved by the structure in which the driving speed, the value output from a sensor such as the pressure sensor, the magnetic sensor, and the environmental sensor, and the like are acquired as information indicating the pressure fluctuations at the junction P, and the drive mechanism forces the opening of the first communicating portion 521 to change in size. These modifications, however, require the drive mechanism for changing the size of the opening, a detection unit for acquiring a value indicating the pressure fluctuations, or an operation control unit for controlling the result of the detection. This may cause an increase in size, complexity, and cost of the apparatus.

By contrast, with the simple structure in which the flexible valve 524 or the shutter 525 is provided at the first communicating portion 521, it is possible to directly and autonomously adjust the flow resistance in response to fluctuations of a pressure applied to developer at the junction P. This structure has an advantage in size and cost. This structure is also convenient because it responds quickly to temporary error factors other than the change in driving speed.

(5-4) In the embodiment, the trickle discharge mechanism 550 is provided at a downstream end portion of the first conveyance passage 551 that faces the developing roller 57. In some cases, however, the trickle discharge mechanism 550 may be provided at a downstream end portion of the second conveyance passage 541, and may adjust the flow resistance by controlling the size of the opening in the second communicating portion 522.

(5-5) In the embodiment, the structure of the trickle-type developing device having the reverse screw 552 is described. As described in the section of Description of Related Art, however, with the structure in which the amount of discharged toner is controlled not by the reverse screw but by a discharge opening provided at a high portion of the developing chamber, the amount of discharged toner changes depending on a pressure applied to developer. Therefore, by providing, to the above-mentioned structure, the flow resistance adjusting mechanism (a passing developer amount changing mechanism) provided at the opening of the first communicating portion 521 of the present invention, the pressure fluctuations in front of the discharge opening is reduced compared with that in the conventional structure. An effect of keeping the amount of developer relatively constant in the developing chamber is obtained.

(5-6) Although the monochrome printer is taken as an example in the embodiment, the present invention is not limited to the monochrome printer. The present invention may be any of a tandem-type color printer, a copying machine, a facsimile machine, and a compound machine having multiple functions such as a copying function, scanning function, and faxing function, as long as the present invention is an image forming apparatus including the trickle-type developing device.

The embodiment and the modifications described above may be combined one another if at all possible.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A developing device that circulates developer including carrier and toner in a circulation passage having first and second conveyance passages by conveying the developer in a first conveyance direction in the first conveyance passage and conveying the developer in a second conveyance direction in the second conveyance passage, so that the developer is supplied to a developing roller provided along one of the first and second conveyance passages, the developing device comprising:

a first conveyance member provided in the first conveyance passage and driven to rotate to convey the developer in the first conveyance direction;

a communicating passage through which the developer flows from the first conveyance passage to the second conveyance passage;

a second conveyance member provided in the second conveyance passage and driven to rotate to convey the developer that has flowed through the communicating passage in the second conveyance direction;

a discharge passage extending from an end portion of the first conveyance passage located downstream in the first conveyance direction;

a passing developer amount changing mechanism configured to change an amount of developer per unit time passing through the communicating passage, according to a pressure applied to the developer at a junction between the first conveyance passage and the discharge passage, wherein the passing developer amount changing mechanism comprises a detection unit configured to acquire information indicating fluctuations of the pressure applied to the developer at the junction; and a movement control unit to control a moving unit based on the acquired information to change a size of an opening of the communicating passage.

2. The developing device of claim 1, further comprising a third conveyance member that is provided in the discharge passage and driven to rotate to convey the developer in a direction opposite to the first conveyance direction by applying a conveyance force that is smaller than a conveyance force applied by the first conveyance member.

3. The developing device of claim 2, wherein each of the first and third conveyance members is a screw formed by helically winding a blade around the same rotary shaft in an opposite direction.

4. The developing device of claim 1, wherein the passing developer amount changing mechanism increases the amount of developer per unit time as the pressure applied to the developer at the junction increases.

5. The developing device of claim 4, wherein the passing developer amount changing mechanism changes the amount of developer per unit time by changing a size of an opening of the communicating passage from which the developer flows into the communicating passage.

6. A developing device that circulates developer including carrier and toner in a circulation passage having first and second conveyance passages by conveying the developer in a first conveyance direction in the first conveyance passage and conveying the developer in a second conveyance direction in the second conveyance passage, so that the developer is supplied to a developing roller provided along one of the first and second conveyance passages, the developing device comprising:

a first conveyance member provided in the first conveyance passage and driven to rotate to convey the developer in the first conveyance direction;

a communicating passage through which the developer flows from the first conveyance passage to the second conveyance passage;

a second conveyance member provided in the second conveyance passage and driven to rotate to convey the developer that has flowed through the communicating passage in the second conveyance direction;

a discharge passage extending from an end portion of the first conveyance passage located downstream in the first conveyance direction; and a passing developer amount changing mechanism configured to change an amount of developer per unit time passing through the communicating passage, according to a pressure applied to the developer at a junction between the first conveyance passage and the discharge passage, wherein the passing developer amount changing mechanism is a valve made of a flexible material comprising a base fixed to a wall of the communicating passage so as to partially block an opening of the communicating passage and bend as pressure applied to the developer at the junction increases.

7. The developing device of claim 6, wherein the valve has a tapered portion that tapers toward a tip thereof.

8. A developing device that circulates developer including carrier and toner in a circulation passage having first and second conveyance passages by conveying the developer in a first conveyance direction in the first conveyance passage and conveying the developer in a second conveyance direction in the second conveyance passage, so that the developer is supplied to a developing roller provided along one of the first and second conveyance passages, the developing device comprising:

a first conveyance member provided in the first conveyance passage and driven to rotate to convey the developer in the first conveyance direction;

a communicating passage through which the developer flows from the first conveyance passage to the second conveyance passage;

a second conveyance member provided in the second conveyance passage and driven to rotate to convey the developer that has flowed through the communicating passage in the second conveyance direction;

a discharge passage extending from an end portion of the first conveyance passage located downstream in the first conveyance direction; and a passing developer amount changing mechanism configured to change an amount of developer per unit time passing through the communicating passage, according to a pressure applied to the developer at a junction between the first conveyance passage and the discharge passage, wherein the passing developer amount changing mechanism is a valve made of a flexible material provided at the communicating passage so as to partially block an opening of the communicating passage and bend as pressure applied to the developer at the junction increases, and the valve has a flexible portion that becomes more flexible closer to a tip thereof.

9. The developing device of claim 6, wherein the valve is made of one of a foamed elastic material and a resin film.

10. The developing device of claim 5, wherein the passing developer amount changing mechanism includes:

a shutter that is swingably supported by a supporter provided at the communicating passage;

a forcing mechanism configured to apply a force to swing the shutter toward the first conveyance passage; and a swing prohibiting mechanism configured to prohibit the shutter from swinging toward the first conveyance passage further than a predetermined position where the shutter partially blocks the opening of the communicating passage, as the pressure applied to the developer at the junction increases, the shutter swings toward the second conveyance passage against the force applied by the forcing mechanism, thereby increasing the size of the opening of the communicating passage.

11. The developing device of claim 10, wherein the predetermined position is a position where the opening of the communicating passage is maximally blocked by the shutter.

12. The developing device of claim 5, wherein the passing developer amount changing mechanism includes;

a shutter configured to partially block the opening of the communicating passage, and the moving unit is configured to move the shutter in the communicating passage.

13. An image forming apparatus for forming an image by developing an electrostatic latent image on a photoreceptor using a developing device that circulates developer including carrier and toner in a circulation passage having first and second conveyance passages by conveying the developer in a first conveyance direction in the first conveyance passage and conveying the developer in a second conveyance direction in the second conveyance passage, so that the developer is supplied to a developing roller provided along one of the first and second conveyance passages, wherein the developing device includes:

a first conveyance member provided in the first conveyance passage and driven to rotate to convey the developer in the first conveyance direction;

a communicating passage through which the developer flows from the first conveyance passage to the second conveyance passage;

a second conveyance member provided in the second conveyance passage and driven to rotate to convey the developer that has flowed through the communicating passage in the second conveyance direction;

a discharge passage extending from an end portion of the first conveyance passage located downstream in the first conveyance direction;

a passing developer amount changing mechanism configured to change an amount of developer per unit time passing through the communicating passage, according to a pressure applied to the developer at a junction between the first conveyance passage and the discharge passage, wherein the passing developer amount changing mechanism comprises a detection unit configured to acquire information indicating fluctuations of the pressure applied to the developer at the junction; and a movement control unit to control a moving unit based on the acquired information to change a size of an opening of the communicating passage.

14. The image forming apparatus of claim 13, wherein the developing device further includes a third conveyance member that is provided in the discharge passage and driven to rotate to convey the developer in a direction opposite to the first conveyance direction by applying a conveyance force that is smaller than a conveyance force applied by the first conveyance member.

15. The image forming apparatus of claim 13, wherein the passing developer amount changing mechanism increases the amount of developer per unit time as the pressure applied to the developer at the junction increases.

16. The image forming apparatus of claim 15, wherein the passing developer amount changing mechanism changes the amount of developer per unit time by changing a size of an opening of the communicating passage from which the developer flows into the communicating passage.

17. An image forming apparatus for forming an image by developing an electrostatic latent image on a photoreceptor using a developing device that circulates developer including carrier and toner in a circulation passage having first and second conveyance passages by conveying the developer in a first conveyance direction in the first conveyance passage and conveying the developer in a second conveyance direction in the second conveyance passage, so that the developer is supplied to a developing roller provided along one of the first and second conveyance passages, wherein the developing device includes:

a first conveyance member provided in the first conveyance passage and driven to rotate to convey the developer in the first conveyance direction;

a communicating passage through which the developer flows from the first conveyance passage to the second conveyance passage;

a second conveyance member provided in the second conveyance passage and driven to rotate to convey the developer that has flowed through the communicating passage in the second conveyance direction;

a discharge passage extending from an end portion of the first conveyance passage located downstream in the first conveyance direction; and a passing developer amount changing mechanism configured to change an amount of developer per unit time passing through the communicating passage, according to a pressure applied to the developer at a junction between the first conveyance passage and the discharge passage, wherein the passing developer amount changing mechanism is a valve made of a flexible material comprising a base fixed to a wall of the communicating passage so as to partially block an opening of the communicating passage and bend as pressure applied to the developer at the junction increases.

18. The image forming apparatus of claim 16, wherein the passing developer amount changing mechanism includes:

a shutter that is swingably supported by a supporter provided at the communicating passage;

a forcing mechanism configured to apply a force to swing the shutter toward the first conveyance passage; and a swing prohibiting mechanism configured to prohibit the shutter from swinging toward the first conveyance passage further than a predetermined position where the shutter partially blocks the opening of the communicating passage, as the pressure applied to the developer at the junction increases, the shutter swings toward the second conveyance passage against the force applied by the forcing mechanism, thereby increasing the size of the opening of the communicating passage.

19. The image forming apparatus of claim 16, wherein the passing developer amount changing mechanism includes;

a shutter configured to partially block the opening of the communicating passage, and the moving unit is configured to move the shutter in the communicating passage.

* * * * *